US005178751A

United States Patent [19]

Pappas

[11] Patent Number: 5,178,751

[45] Date of Patent: Jan. 12, 1993

[54] TWO-STAGE PROCESS FOR PURIFYING A HYDROGEN GAS AND RECOVERING LIQUIFIABLE HYDROCARBONS FROM HYDROCARBONACEOUS EFFLUENT STREAMS

[75] Inventor: Scott W. Pappas, Crystal Lake, Ill.

[73] Assignee: UOP, Des Plaines, Ill.

[21] Appl. No.: 800,195

[22] Filed: Nov. 27, 1991

[51] Int. Cl.[5] ..... C10G 25/06; C10G 35/04

[52] U.S. Cl. ..... 208/340; 208/100; 208/101; 208/133; 208/134

[58] Field of Search ..... 208/340, 100, 101, 133, 208/134

[56] References Cited

U.S. PATENT DOCUMENTS

| | | | |
|---|---|---|---|
| 3,431,195 | 3/1969 | Storch et al. | 208/101 |
| 3,516,924 | 6/1970 | Forbes | 208/65 |
| 3,520,799 | 7/1970 | Forbes | 208/101 |
| 3,520,800 | 7/1970 | Forbes | 208/101 |
| 3,882,014 | 5/1975 | Monday et al. | 208/134 |
| 3,959,119 | 5/1976 | Kondo | 208/100 |
| 4,002,432 | 1/1977 | Brice et al. | 208/100 |
| 4,159,937 | 7/1974 | Scott | 208/100 |
| 4,212,726 | 7/1980 | Mayes | 208/101 |
| 4,364,820 | 12/1982 | DeGraff et al. | 208/101 |
| 4,374,726 | 2/1983 | Schmelzer et al. | 208/101 |
| 4,568,451 | 2/1986 | Greenwood | 208/100 |
| 4,925,573 | 5/1990 | Vorlow | 208/100 |

OTHER PUBLICATIONS

Nov. 10, 1989 issue of the Oil and Gas Journal, pp. 191-197, "Catalytic LPG Dehydrogenation Fits in 80's Outlook" by R. C. Berg, J. R. Mowry & B. V. Vora, Nov 19, 1980.

*Primary Examiner*—Helane Myers

*Attorney, Agent, or Firm*—Thomas K. McBride; John G. Tolomei

[57] ABSTRACT

A process for recovering hydrogen-rich gases and increasing the recovery of liquid hydrocarbon products from a hydrocarbon conversion zone effluent is improved by a particular arrangement of a refrigeration zone and two separation zones.

17 Claims, 3 Drawing Sheets

TWO-STAGE PROCESS FOR PURIFYING A HYDROGEN GAS AND RECOVERING LIQUIFIABLE HYDROCARBONS FROM HYDROCARBONACEOUS EFFLUENT STREAMS

BACKGROUND OF THE INVENTION

FIELD OF THE INVENTION

The present invention is related to methods for recovering a hydrogen-rich gas stream from a hydrogen and hydrocarbon effluent of a catalytic hydrocarbon conversion zone. In addition this invention improves the recovery of liquifiable hydrocarbons from hydrogen and hydrocarbon effluent streams.

Various types of catalytic hydrocarbon conversion reaction systems have found widespread utilization throughout the petroleum and petrochemical industries for effecting the conversion of hydrocarbons to different products. The reactions employed in such systems are either exothermic or endothermic, and of more importance to the present invention, often result in either the net production of hydrogen or the net consumption of hydrogen. Such reaction systems, as applied to petroleum refining, have been employed to effect numerous hydrocarbon conversion reactions including those which predominate in catalytic reforming, ethylbenzene dehydrogenation to styrene, propane and butane dehydrogenation, etc.

Petroleum refineries and petrochemical complexes customarily comprise numerous reaction systems. Some systems within the refinery or petrochemical complex may result in the net production of hydrogen. Because hydrogen is relatively expensive, it has become the practice within the art of hydrocarbon conversion to supply hydrogen from reaction systems which result in the net production of hydrogen to reaction systems which are net consumers of hydrogen. Occasionally, the net hydrogen being passed to the net hydrogen-consuming reactions systems must be of high purity due to the reaction conditions and/or the catalyst employed in the systems. Such a situation may require treatment of the hydrogen from the net hydrogen-producing reaction systems to remove hydrogen sulfide, light hydrocarbons, etc. from the net hydrogen stream.

Alternatively, the hydrogen balance for the petroleum refinery or petrochemical complex may result in excess hydrogen, i.e., the net hydrogen-producing reaction systems produce more hydrogen than is necessary for the net hydrogen-consuming reaction systems. In such an event, the excess hydrogen may be sent to the petroleum refinery or petrochemical complex fuel system. However, because the excess hydrogen often has admixed therewith valuable components, such as $C_3+$ hydrocarbons, it is frequently desirable to treat the excess hydrogen to recover these components prior to its passage to fuel.

Typical of the net hydrogen-producing hydrocarbon reaction systems are catalytic reforming, catalytic dehydrogenation of alkylaromatics and catalytic dehydrogenation of paraffins. Commonly employed net hydrogen-consuming reaction systems are hydrotreating, hydrocracking and catalytic hydrogenation. Of the abovementioned net hydrogen-producing and consuming hydrocarbon reaction systems, catalytic reforming ranks as one of the most widely employed. By virtue of its wide application and its utilization as a primary source of hydrogen for the net hydrogen-consuming reactions systems, catalytic reforming has become well known in the art of hydrocarbon conversion reaction systems.

It is well known that high quality petroleum products in the gasoline boiling range including, for example, aromatic hydrocarbons such as benzene, toluene and the xylenes, are produced by the catalytic reforming process wherein a naphtha fraction is passed to a reaction zone wherein it is contacted with a platinum-containing catalyst in the presence of hydrogen. Generally, the catalytic reforming reaction zone effluent, comprising gasoline boiling range hydrocarbons and hydrogen, is passed to a vapor-liquid equilibrium separation zone and is therein separated into a hydrogen-containing vapor phase and an unstabilized hydrocarbon liquid phase. A portion of the hydrogen-containing vapor phase may be recycled to the reaction zone. The remaining hydrogen-containing vapor phase is available for use either by the net hydrogen-consuming processes or as fuel for the petroleum refinery or petrochemical complex fuel system. While a considerable portion of the hydrogen-containing vapor phase is required for recycle purposes, a substantial net excess is available for the other uses.

Because the dehydrogenation of naphthenic hydrocarbons is one of the predominant reactions of the reforming process, substantial amounts of hydrogen are generated within the catalytic reforming reaction zone. Accordingly, a net excess of hydrogen is available for use as fuel or for use in a net hydrogen-consuming process such as the hydrotreating of sulfur-containing petroleum feedstocks. However, catalytic reforming also involves a hydrocracking function among the products of which are relatively low molecular weight hydrocarbons including methane, ethane, propane, butanes and the pentanes, substantial amounts of which appear in the hydrogen-containing vapor phase separated from the reforming reaction zone effluent. These normally gaseous hydrocarbons have the effect of lowering the hydrogen purity of the hydrogen-containing vapor phase to the extent that purification is often required before the hydrogen is suitable for other uses. Moreover, if the net excess hydrogen is intended for use as fuel in the refinery or petrochemical complex fuel system, it is frequently desirable to maximize the recovery of $C_3+$ hydrocarbons which are valuable as feedstock for other processes.

Many processes for the purification of hydrogen-rich gas streams from the effluent of hydrocarbon conversion reaction zones are disclosed. U.S. Pat. No. 3,431,195, issued Mar. 4, 1969, discloses a process wherein the hydrogen and hydrocarbon effluent of a catalytic reforming zone is first passed to a low pressure vapor-liquid equilibrium separation zone from which zone is derived a first hydrogen-containing vapor phase and a first unstabilized hydrocarbon liquid phase. The hydrogen-containing vapor phase is compressed and recontacted with at least a portion of the liquid phase and the resulting mixture is passed to a second high pressure vapor-liquid equilibrium separation zone. Because the second zone is maintained at a higher pressure, a new vapor liquid equilibrium is established resulting in a hydrogen-rich gas phase and a second unstabilized hydrocarbon liquid phase. A portion of the hydrogen-rich vapor phase is recycled back to the catalytic reforming reaction zone with the balance of the hydrogen-rich vapor phase being recovered as a hydrogen-rich gas stream relatively free of $C_3$-$C_6$ hydrocarbons.

U.S. Pat. No. 3,516,924, issued Jun. 23, 1970, discloses a system wherein the reaction zone effluent from a catalytic reforming process is first separated in a vapor-liquid equilibrium separation zone to produce a hydrogen-containing vapor phase and an unstabilized liquid hydrocarbon phase. The two phases are again recontacted and again separated in a higher pressure vapor-liquid equilibrium separation zone. A first portion of the resulting hydrogen-rich vapor phase is recycled back to the catalytic reforming zone while the remaining portion of the hydrogen-rich vapor phase is passed to an absorber column in which stabilized reformate is utilized as the sponge oil. A high purity hydrogen gas stream is recovered from the absorption zone and the sponge oil, containing light hydrocarbons, is recontacted with the hydrocarbon liquid phase from the first vapor-liquid equilibrium separation zone prior to the passage thereof to the second high pressure vapor-liquid equilibrium separation zone.

U.S. Pat. No. 3,520,800, issued Jul. 14, 1970, discloses a method of obtaining a hydrogen-rich gas stream from a catalytic reforming reaction zone effluent. As in the previously discussed methods, the reforming reaction zone effluent is passed to a first vapor-liquid equilibrium separation zone from which is obtained a first hydrogen-containing vapor phase and a first unstabilized hydrocarbon liquid phase. The hydrogen-containing vapor phase is compressed and recontacted with the hydrocarbon liquid phase. Thereafter the mixture is passed to a second vapor-liquid equilibrium separation zone maintained at a higher pressure than the first vapor-liquid equilibrium separation zone. A second hydrogen-containing vapor phase of higher hydrogen purity is recovered from the second vapor-liquid equilibrium separation zone with a portion thereof being recycled back to the catalytic reforming reaction zone. The remaining amount of the resulting hydrogen-containing vapor phase is passed to a cooler wherein the temperature of the phase is reduced at least 20° F. lower than the temperature maintained in the second vapor-liquid equilibrium separation zone. After cooling, the hydrogen phase is passed to a third vapor-liquid equilibrium separation zone from which a high purity hydrogen gas stream is recovered.

U.S. Pat. No. 3,520,799, issued Jul. 14, 1970, discloses yet another method for obtaining a high purity hydrogen gas stream from a catalytic reforming reaction zone effluent. As in all the previous schemes, the reaction zone effluent is passed to a low pressure vapor-liquid equilibrium separation zone from which is produced a hydrogen-containing vapor phase and an unstabilized liquid hydrocarbon phase. After compression, the hydrogen-containing vapor phase is recontacted with the unstabilized liquid hydrocarbon phase and the resulting mixture is passed to a high pressure vapor-liquid equilibrium separation zone. A second hydrogen-containing vapor phase is produced of higher purity than the hydrogen-containing vapor phase from the low pressure vapor-liquid equilibrium separation zone. A first portion of this higher purity hydrogen-containing vapor phase is recycled back to the catalytic reforming zone. The balance of the higher purity hydrogen-containing vapor phase is passed to an absorption zone where it is contacted with a lean sponge oil preferably comprising $C_6$+ hydrocarbons. A hydrogen-containing gas stream is removed from the absorber and after cooling, passed to a third vapor-liquid equilibrium separation zone. The sponge oil, containing constituents absorbed from the higher purity hydrogen-containing vapor phase is removed from the absorption zone and is admixed with the unstabilized liquid hydrocarbon stream from the low pressure vapor-liquid equilibrium separation zone prior to the recontacting thereof with the compressed hydrogen-containing vapor phase. A stream of high purity hydrogen gas is removed from the third vapor-liquid equilibrium separation zone.

U.S. Pat. No. 3,882,014, issued May 6, 1975, discloses another method of obtaining a high purity hydrogen stream from the reaction zone effluent of a catalytic reforming process. The catalytic reforming reaction zone effluent is first passed to a vapor-liquid equilibrium separation zone from which is recovered an unstabilized liquid hydrocarbon stream and a hydrogen-containing vapor phase. After compression, the hydrogen-containing vapor phase is passed to an absorption zone wherein it is contacted with a sponge oil comprising stabilized reformate. A high purity hydrogen gas stream is recovered from the absorption zone with one portion thereof being recycled back to the catalytic reforming reaction zone while the remainder is recovered for further use. A liquid stream is recovered from the absorption zone and admixed with the unstabilized liquid hydrocarbon stream from the vapor-liquid equilibrium separation zone. The admixture is then fractionated in a stabilizing column to produce the stabilized reformate, a first portion of which is utilized as the sponge oil in the absorption zone.

U.S. Pat. No. 4,212,726, issued Jul. 15, 1980, discloses a method for recovering high purity hydrogen streams from catalytic reforming reaction zone effluents wherein the reaction zone effluent from the catalytic reforming process is passed to a first vapor-liquid equilibrium separation zone from which is recovered a first unstabilized hydrocarbon stream and a first hydrogen-containing vapor stream. After compression, the hydrogen-containing vapor stream is passed to an absorption column wherein it is contacted with the first liquid hydrocarbon phase from the vapor-liquid equilibrium separation zone and stabilized reformate. A high purity hydrogen gas stream is recovered from the absorption zone with one portion being recycled back to the reaction zone and the balance being recovered for further use.

U.S. Pat. No. 4,364,820, issued Dec. 21, 1982, discloses a method of recovering high purity hydrogen gas from a catalytic reforming reaction zone effluent wherein the reaction zone effluent is first separated in a vapor-liquid equilibrium separation zone into a first hydrogen-containing vapor phase and a first liquid hydrocarbon phase. One portion of the first hydrogen-containing vapor phase is compressed and recycled back to the catalytic reaction zone. The balance of the hydrogen-containing vapor phase is compressed and contacted with a second liquid hydrocarbon phase recovered from a hereinafter described third vapor-liquid equilibrium separation zone. The admixture is then passed to a second vapor-liquid equilibrium separation zone from which is derived a third liquid hydrocarbon phase comprising unstabilized reformate and a second hydrogen-containing vapor phase of higher purity than the first hydrogen-containing vapor phase derived from the first vapor-liquid equilibrium separation zone. The second hydrogen-containing vapor phase is subjected to compression and then contacted with the first liquid hydrocarbon phase from the first vapor-liquid equilibrium separation zone. The resulting admixture is then passed to a third vapor-liquid equilibrium separation zone from which is derived a hydrogen gas stream of high purity and the aforementioned second liquid hydrocarbon phase.

U.S. Pat. No. 4,374,726, issued Feb. 22, 1983, discloses a further method of obtaining a high purity hydrogen gas stream from the reaction zone effluent of a catalytic reforming process. In this reference, the reaction zone effluent is passed to a vapor-liquid equilibrium separation zone to produce a first hydrocarbon liquid phase and a hydrogen-containing vapor phase. A first portion of the hydrogen-containing vapor phase is compressed and recycled to the catalytic reforming reaction zone. A second portion of the hydrogen-containing vapor phase is compressed and thereafter recontacted with the first liquid hydrocarbon phase from the vapor-liquid equilibrium separation zone. The resulting admixture is then passed to a second vapor-liquid equilibrium separation zone to produce a hydrogen gas stream of high purity and a second liquid hydrocarbon phase comprising unstabilized reformate.

U.S. Pat. No. 4,568,451, issued Feb. 4, 1986 discloses a method of recovering high purity hydrogen gas from a catalytic reforming reaction zone effluent wherein the reaction zone effluent is first separated in a vapor-liquid equilibrium separation zone into a first hydrogen-containing vapor phase and a first unstabilized liquid hydrocarbon phase. One portion of the first hydrogen-containing vapor phase is compressed and recycled back to the catalytic reaction zone. The balance of the hydrogen-rich vapor phase is admixed with a portion of the first unstabilized liquid reformate chilled and passed to an equilibrium separator from which a hydrogen-rich vapor phase and a second liquid hydrocarbon phase comprising unstabilized reformate are recovered.

In addition to the above-mentioned patent literature, the technical literature within the art has also disclosed methods for separating reaction zone effluents to obtain hydrogen-containing gas streams. For example, the Nov. 10, 1980 issue of the Oil and Gas Journal discloses an LPG dehydrogenation process in which the entire reaction zone effluent is first dried, then subjected to indirect heat exchange with a cool hydrogen-containing gas stream. The cool hydrogen-containing gas stream is derived by passing the entire cooled reaction zone effluent to a vapor-liquid equilibrium separation zone. The hydrogen-containing gas stream is removed from the separation zone and is then expanded. Thereafter it is subjected to indirect heat exchange with the entire reaction zone effluent. After the indirect heat exchange step, a portion of the hydrogen-containing vapor phase is recycled to the reaction zone.

The many art references have shown many similar arrangements of chillers, separators, absorbers, compressors, and heat exchange equipment for recovering a hydrogen-rich gas stream and liquifiable hydrocarbon components from a hydrocarbonaceous effluent of a catalytic conversion zone. Out of the many combinations of such components that can be used, it has been discovered that a particular arrangement of separators and refrigeration equipment will dramatically improve the recovery of liquifiable hydrocarbons in such a system with only a relatively simple arrangement of components.

SUMMARY OF THE INVENTION

It has been discovered that by the use of a simple pre-cooling step in combination with an additional separation zone, significant additional recoveries of $C_4$ and, in particular, $C_3$ hydrocarbons can be obtained.

Accordingly, in one embodiment, this invention is a process for producing a hydrogen-rich gas stream by treating a hydrogen and hydrocarbon effluent from a catalytic hydrocarbon conversion reaction zone. In the process, at least a portion of the effluent is passed to a vapor-liquid separation zone and split into a hydrogen-containing vapor phase and a first liquid phase comprising hydrocarbons. At least a portion of the hydrogen-containing vapor phase is cooled by indirect heat exchange with a first hydrogen-rich gas stream. A portion of the first liquid phase comprising 10 to 50 vol.% of the total first liquid phase is cooled by indirect heat exchange with a second liquid phase. The heat exchanged portion of the hydrogen-containing vapor phase and a portion of the heat exchanged portion of the first liquid phase are admixed to produce a first admixture and passed to a second liquid vapor liquid separation zone to produce a second hydrogen gas stream and a third liquid phase. The second hydrogen-rich gas phase is refrigerated and mixed with a portion of the first liquid phase to obtain a refrigerated second admixture. The refrigerated second admixture is passed to a third vapor liquid separation zone to produce the first hydrogen-rich gas phase and a fourth liquid phase. The third and fourth liquid phases are combined to produce the second liquid phase which is recovered after the heat exchange of the second liquid phase with the first liquid phase. The first hydrogen-rich gas phase is recovered after heat exchange with the hydrogen-containing vapor phase.

In another embodiment, this invention is a process for producing a hydrogen-rich gas stream by treating a hydrogen and hydrocarbon effluent from a catalytic reforming reaction zone. The hydrogen and hydrocarbon effluent is passed to a first vapor-liquid equilibrium separation zone and a hydrogen-containing vapor phase and a first unstabilized liquid reformate are recovered therefrom. A first portion of the hydrogen-containing vapor phase is recycled to the catalytic reforming reaction zone. A second portion of the hydrogen-containing vapor phase is cooled by indirect heat exchange with a first hydrogen-rich gas stream. About 20 to 40 vol. % of the first unstabilized liquid reformate is cooled by indirect heat exchange with a second unstabilized liquid reformate. The heat exchanged portion of the hydrogen-containing vapor phase and a portion of the heat exchanged portion of the first unstabilized liquid reformate is admixed to produce a first admixture and passed to a second vapor liquid separation zone to produce a second hydrogen-rich gas stream and a third unstabilized liquid reformate. The second hydrogen-rich gas stream is refrigerated and admixed with a portion of the first unstabilized liquid reformate to obtain a refrigerated second admixture. The refrigerated second admixture is passed to a third vapor liquid separation zone to produce the first hydrogen-rich gas stream and a fourth unstabilized liquid reformate. The third and fourth unstabilized liquid reformates are combined to produce the second unstabilized liquid reformate which is recovered after heat exchange with the second of the hydrogen-containing vapor phase. The first hydrogen-rich gas phase is recovered after the heat exchange with the first portion of the hydrogen-containing vapor phase.

DETAILED DESCRIPTION OF THE INVENTION

Figure 1:
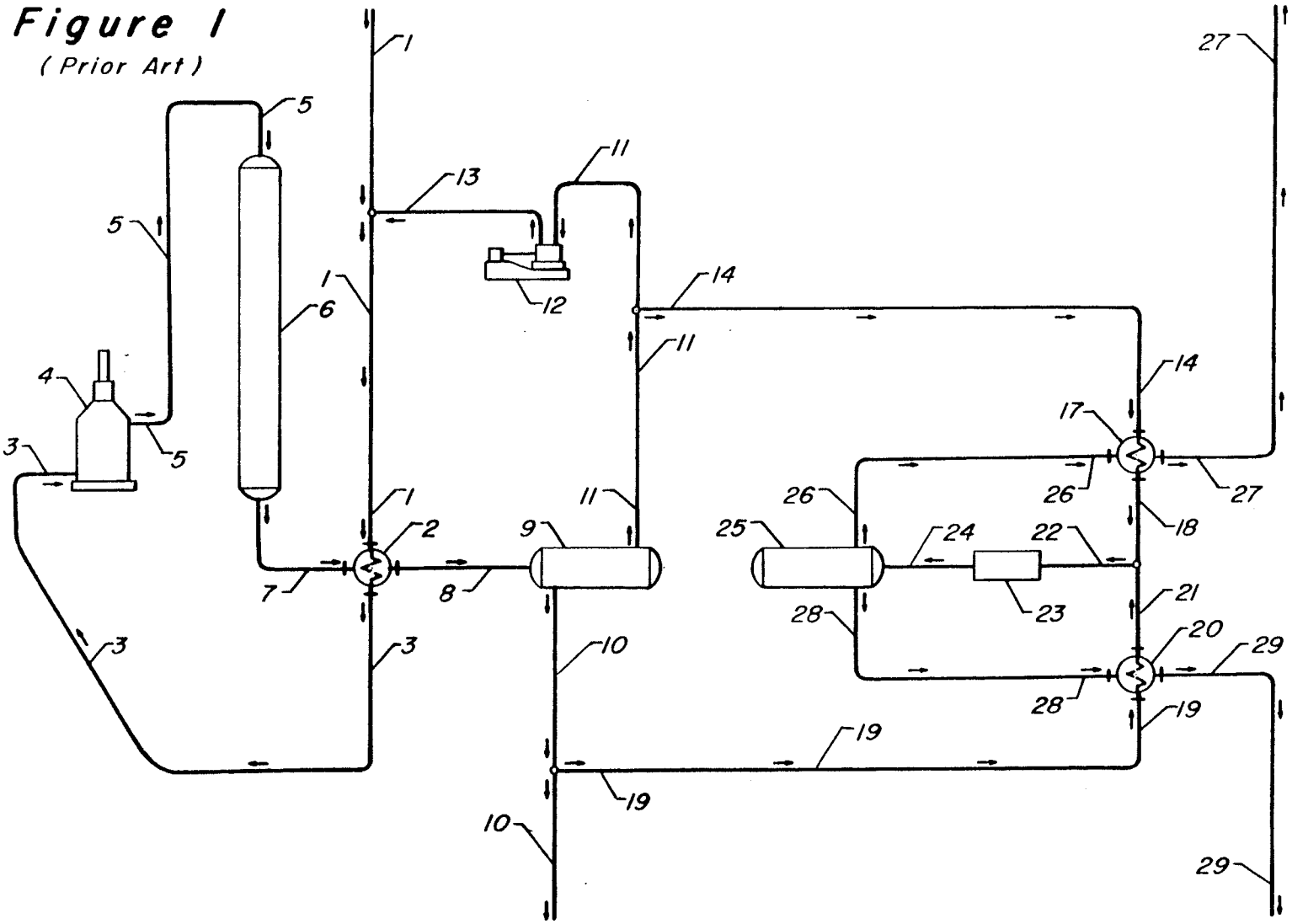
Figure 1 (Prior Art)
FIG. 1 illustrates a reforming process and a prior art separation arrangement for recovering a hydrogen-rich product and a liquid reformate.

The process of this invention is suitable for use in hydrocarbon conversion reaction systems which may be characterized as single or multiple reaction zones in which catalyst particles are disposed as fixed beds or movable via gravity flow. Moreover, the present invention may be advantageously utilized in hydrocarbon conversion reaction systems which result in the net production or the net consumption of hydrogen. Although the following discussion is specifically directed toward catalytic reforming of naphtha boiling range fractions, there is no intent to so limit the present invention.

The art of catalytic reforming is well known to the petroleum refining and petrochemical processing industry. Accordingly, a detailed description thereof is not required herein. In brief, the catalytic reforming art is largely concerned with the treatment of a petroleum gasoline fraction to improve its anti-knock characteristics. The petroleum fraction may be a full boiling range gasoline fraction having an initial boiling point of from about 50° to about 100° F. and an end boiling point from about 325° to about 425° F. More frequently the gasoline fraction will have an initial boiling point of about 150° to about 250° F. and an end boiling point of from about 350° to 425° F., this higher boiling fraction being commonly referred to as naphtha. The reforming process is particularly applicable to the treatment of those straight-run gasolines comprising relatively large concentrations of naphthenic and substantially straight-chain paraffinic hydrocarbons which are amenable to aromatization through dehydrogenation and/or cyclization. Various other concomitant reactions also occur, such as isomerization and hydrogen transfer, which are beneficial in upgrading the anti-knock properties of the selected gasoline fraction. In addition to improving the anti-knock characteristics of the gasoline fraction, the tendency of the process to produce aromatics from naphthenic and paraffinic hydrocarbons makes catalytic reforming an invaluable source for the production of benzene, toluene, and xylenes which are all of great utility in the petrochemical industry.

Widely accepted catalysts for use in the reforming process typically comprise platinum on an alumina support. These catalysts will generally contain from about 0.05 to about 5 wt. % platinum. Certain promoters or modifiers, such as cobalt, nickel, rhenium, germanium and tin, have been incorporated into the reforming catalysts to enhance its performance.

The catalytic reforming of naphtha boiling range hydrocarbons, a vapor phase operation, is effected at conversion conditions which include catalyst bed temperatures in the range of from about 700° to about 1020° F. Other conditions generally include a pressure of from about 20 to about 1000 psig, a liquid hourly space velocity (defined as volumes of fresh charge stock per hour per volume of catalyst particles in the reaction zone) of from about 0.2 to about 10 $hr.^{-1}$ and a hydrogen to hydrocarbon mole ratio generally in the range of from about 0.5:1 to about 10:1.

The catalytic reforming reaction is carried out at the aforementioned reforming conditions in a reaction zone comprising either a fixed or a moving catalyst bed. Usually, the reaction zone will comprise a plurality of catalyst beds, commonly referred to as stages, and the catalyst beds may be stacked and enclosed within a single reactor vessel, or the catalyst beds may each be enclosed in a separate reactor vessel in a side-by-side reactor arrangement. Generally, a reaction zone will comprise two to four catalyst beds in either the stacked and/or side-by-side configuration. The amount of catalyst used in each of the catalyst beds may be varied to compensate for the endothermic heat of reaction in each case. For example, in a three-catalyst bed system, the first bed will generally contain from about 10 to about 30 vol. %; the second, from about 25 to about 45 vol. %; and the third, from about 40 to about 60 vol. %, all percentages being based on the amount of catalyst within the reaction zone. With respect to a four-catalyst bed system, suitable catalyst loadings would be from about 5 to about 15 vol. % in the first bed, from about 15 to about 25 vol. % in the second, from about 25 to about 35 vol. % in the third, and from about 35 to about 50 vol. % in the fourth. The reactant stream, comprising hydrogen and the hydrocarbon feed, should desirably flow serially through the reaction zones in order of increasing catalyst volume and interstage heating. The unequal catalyst distribution, increasing in the serial direction of reactant stream flow, facilitates and enhances the distribution of the reactions.

Continuous regenerative reforming systems offer numerous advantages when compared to the fixed bed systems. Among these is the capability of efficient operation at comparatively lower pressures, e.g., 20 to about 200 psig, and higher liquid hourly space velocities, e.g., about 3 to about 10 $hr.^{-1}$. As a result of continuous catalyst regeneration, higher consistent inlet catalyst bed temperatures can be maintained, e.g., 950° to about 1010° F. Furthermore, there is afforded a corresponding increase in hydrogen production and hydrogen purity in the hydrogen-containing vaporous phase from the product separation facility.

Upon removal of the hydrocarbon and hydrogen effluent from the catalytic reaction zone, it is customarily subjected to indirect heat exchange typically with the hydrogen and hydrocarbon feed to the catalytic reaction zone. Such an indirect heat exchange aids in the further processing of the reaction zone effluent by cooling it and recovers heat which would otherwise be lost for further use in the catalytic reforming process. Following any such cooling step, which may be employed, the reaction zone effluent is passed to a vapor-liquid equilibrium separation zone to recover a hydrogen-containing vapor phase from the effluent, at least a portion of which is to be recycled back to the reforming zone. The vapor-liquid equilibrium separation zone is usually-maintained at substantially the same pressure as employed in the reforming reaction zone, allowing for the pressure drop in the system. The temperature within the vapor-liquid equilibrium separation zone is typically maintained at about 60° to about 120° F. The temperature and pressure are selected in order to produce a hydrogen-containing vapor phase and a principally liquid phase comprising unstabilized reformate.

As noted previously, the catalytic reforming process generally requires the presence of hydrogen within the reaction zone. Although this hydrogen may come from any suitable source, it has become the common practice to recycle a portion of the hydrogen-containing vapor phase derived from the vapor-liquid equilibrium separation zone to provide at least part of the hydrogen required to assure proper functioning of the catalytic reforming process. The balance of the hydrogen-containing vapor phase is therefore available for use elsewhere. As noted above, a principally liquid phase comprising unstabilized reformate is withdrawn from the first vapor-liquid equilibrium separation zone. Pursuant to the invention, a portion of this unstabilized liquid reformate comprising from about 10 to 50 vol. % of the total reformate, and preferably 20 to 40 vol. %, is passed to a heat exchange means for indirect heat exchange with a hereinafter defined second unstabilized liquid reformate. After subjecting it to indirect heat exchange, the unstabilized liquid reformate is admixed with the hydrogen-containing vapor phase which has also been subjected to indirect heat exchange.

Heat exchange of the hydrogen-containing vapor phase with the hydrogen-rich vapor phase pre-cools the hydrogen-containing vapor phase before it enters the second separation zone. Similarly heat exchange of the liquid hydrocarbon stream from the first separator with the liquid product stream precools the liquid hydrocarbons stream that enters the second separator. This precooling will usually provide enough of a temperature reduction in the hydrogen-containing vapor phase to produce favorable equilibrium conditions in the second separation zone for reducing the content of liquifiable hydrocarbons in the hydrogen-containing overhead from the second separation zone.

As the resulting admixture is passed to the second vapor-liquid equilibrium separation zone, the composition temperature and pressure of the gas and vapor liquid entering the second vapor liquid equilibrium separation zone is different from that in the first separation zone so that a new vapor equilibrium is established. Generally, the conditions within the second zone will include a temperature of from 25° F. to 75° F., preferably, in a range of from 40° F. to 60° F. and a pressure of from 50 to 500 psig. This second separation zone is generally operated at relatively warm conditions that will maximize the absorption of the liquifiable hydrocarbons by the liquid reformate stream. The separation zone usually consists of an open vessel that operates in the nature of a flash drum. The pressure and temperature conditions within the second separation zone will be set in order recover a hydrogen-rich stream of medium purity. For the purposes of this invention medium purity will usually mean a purity of 85 to 95 mol % hydrogen.

The hydrogen-rich stream from the second separation zone is admixed with another portion of the liquid reformate stream and subjected to refrigeration. The admixing of the liquid reformate stream with the hydrogen-rich vapor stream from the second separation zone can be done before or after refrigeration. The refrigeration lowers the temperature of the hydrogen-rich vapor stream and the liquid stream admixed therewith to a temperature of between −15° to 40° F. and preferably between −15° and 40° F.

After refrigeration and the addition of the liquid reformate stream, a second admixture is formed that will have a temperature of from −15° to 40° F. as it enters the third separation zone. The third separation zone will normally operate in a pressure range of from 50 to 500 psig.

The third separation zone uses a separator that is similar to that used for the second separation zone. This is again an equilibrium separation zone that now has equilibrium conditions that will transfer a further amount of the liquifiable hydrocarbons in the hydrogen-rich gas phase to the liquid reformate stream.

By the use of this invention, it has been determined that the overall addition of the liquified reformate stream to the second and third separation zones can be kept in the range of from 10 to 50 vol. % of the unstabilized liquid reformate. In relation to the hydrocarbon vapor, the molar ratio of the first liquid phase passing in indirect heat exchange to the hydrocarbon vapor is about 0.2 to 0.6 and preferably in a range of 0.25 to 0.5. Typically, the relative proportion of unstabilized liquid reformate sent to the second separation zone is in the range of from 5 to 25 vol. % and preferably in the range of 10 to 20 vol. % of the total liquid reformate stream with the balance sent to the third separation zone. In terms of the relative ratios between the two separation zones, about 40 to 60 vol. % of the liquid reformate is sent to one second separation zone with the balance passing to the third separation zone.

The vapor stream from the third separation zone provides substantial cooling to the hydrogen-containing vapor stream that forms a portion of the first admixture. Additional cooling of the liquid reformate stream is provided by the combined bottom streams from the second and third separation zones. It is possible to separately heat exchange the liquid stream from the third separation zone with the portion of the liquid stream that is admixed with the gas stream for the second separation zone in order to reduce the temperature of the admixture entering the second separation zone. This would be particularly useful when refrigeration is not used on the admixture entering the second separation zone. In some cases it may be desirable to provide refrigeration of the first admixture that enters the second separation zone. In such cases the temperature of the admixture will usually be in a range of from −15° to 15° F. before it enters the second separation zone and will have a pressure of from 50 to 500 psig. For most applications of this invention it has been found that such additional refrigeration is not beneficial.

As will readily be recognized by the practitioner, upon pre-cooling, a small portion of the hydrogen-containing vapor phase may condense; however, it is to be understood that the term "hydrogen-containing vapor phase" as used herein is intended to include that small condensed portion. Hence, the entire hydrogen-containing vapor phase including any portion thereof condensed upon pre-cooling is admixed with the unstabilized liquid reformate.

In accordance with the present invention, at least the hydrogen-rich vapor phase, and possibly the hydrogen-containing vapor phase is subjected to refrigeration. Although not typically necessary for catalytic reforming, it may be necessary to assure that these hydrogen vapor phase streams are sufficiently dry prior to refrigeration. Drying of the hydrogen-containing vapor phase may be necessary because water, intentionally injected into the reaction zone or comprising a reaction zone feed contaminant, must be substantially removed to avoid formation of ice upon refrigeration. By drying the hydrogen-containing vapor phase, formation of ice and the resulting reduction of heat transfer coefficients in the heat exchanger of the refrigeration unit utilized to effect the cooling are avoided.

If drying is required, it may be effected by any means known in the art. Absorption using liquid desiccants such as ethylene glycol, diethylene glycol, and triethylene glycol may be advantageously employed. In such an absorption system, a glycol desiccant is contacted with the hydrogen-containing vapor phase in an absorber column. Water-rich glycol is then removed from the absorber and passed to a regenerator wherein the water is removed from the glycol desiccant by application of heat. The resulting lean glycol desiccant is then recycled to the absorber column for further use. As an alternative to absorption using liquid desiccants, drying may also be effected by adsorption utilizing a solid desiccant. Alumina, silica gel, silica-alumina beads, and molecular sieves are typical of the solid desiccants which may be employed. Generally, the solid desiccant will be placed in at least two beds in a parallel flow configuration. While the hydrogen-containing vapor phase is passed through one bed of desiccant, the remaining bed or beds are regenerated. Regeneration is generally effected by heating to remove desorbed water and purging the desorbed water vapor from the desiccant bed. The beds of desiccant may, therefore, be cyclically alternated between drying and regeneration to provide continuous removal of water from the hydrogen-containing vapor phase.

In regard to refrigeration, any suitable refrigeration means may be employed. For example, a simple cycle comprising a refrigerant evaporator, compressor, condenser, and expansion valve or if desired, a more complex cascade system may be employed. The exact nature and configuration of the refrigeration scheme is dependent on the desired temperature of the refrigerated admixture and in turn that temperature is dependent on the composition of the admixture and the desired hydrogen purity of the hydrogen-rich gas. Preferably, the temperature should be as low as possible with some margin of safety to prevent freezing. Generally, the refrigeration temperature will be from about −15° to 15° F. In addition, it should be noted that the exact desired temperature of the refrigerated admixture will determine whether drying of the hydrogen-containing vapor phase is necessary in order to avoid ice formation within the refrigeration heat exchanger and the concomitant reduction in heat transfer coefficient accompanied therewith. For catalytic reforming, a temperature of about 0° F. is usually suitable without the necessity of drying the hydrogen-containing vapor phase. This is because the water content of the hydrogen-containing vapor phase is about 20 mole ppm.

The reformate withdrawn from the second vapor-liquid separation zone will differ from the first unstabilized liquid reformate in that the second will contain more $C_1+$ material transferred from the hydrogen-containing vapor phase. The unstabilized reformate withdrawn from the second and third, vapor-liquid equilibrium separation zones may be passed to a fractionation zone after being subjected to indirect heat exchange in accordance with the invention. By subjecting the second unstabilized reformate to indirect heat exchange, it is thereby preheated prior to its passage to the fractionation zone. The indirect heat exchange step therefore results in supplementary energy savings by avoiding the necessity of heating the unstabilized reformate from the temperature at which the second and third vapor-liquid equilibrium separation zones are maintained prior to fractionation and also by reducing the refrigeration requirement of the system.

The hydrogen-rich gas stream withdrawn from the third vapor-liquid equilibrium separation zone will preferably have, depending on the conditions therein, a hydrogen purity in excess of 90 mol. %. After subjecting the hydrogen-rich gas stream to indirect heat exchange pursuant to the invention, the hydrogen-rich gas stream may then be passed to other hydrogen-consuming processes or may be utilized in any suitable fashion. It should be noted that by subjecting the hydrogen-rich gas stream to indirect heat exchange with the hydrogen-containing vapor phase, there accrues certain supplementary energy savings. Typically, the hydrogen-rich gas stream must undergo heating before it can be used in a hydrogen-consuming process. Accordingly, by subjecting the hydrogen-rich gas to indirect heat exchange and thereby warming it, energy savings will be achieved, avoiding the necessity of heating the hydrogen-rich gas stream from the temperature maintained in the third vapor-liquid equilibrium separation zone. Additionally, such a heat exchange step decreases the total refrigeration requirements further reducing the energy requirements of the system.

To more fully demonstrate the attendant advantages of the present invention, the following examples, based on thermodynamic analysis, engineering calculations, and estimates are set forth. Details such as miscellaneous pumps, heaters, coolers, valving, start-up lines, and similar hardware have been omitted as being nonessential to a clear understanding of the techniques involved.

DETAILED DESCRIPTION OF THE DRAWINGS

Specifically referring to FIG. 1, a naphtha boiling range hydrocarbon charge stock is introduced via line 1 and mixed with a hydrogen-containing vapor phase recycled via line 13. The admixture is then passed through line 1 to combined feed exchanger 2 wherein the hydrogen and hydrocarbon charge are subjected to indirect heat exchange with the hydrogen and hydrocarbon effluent from the catalytic reforming reaction zone. The thusly preheated hydrogen and hydrocarbon charge mixture is then withdrawn from the combined feed exchanger 2 via line 3. It is then passed into charge heater 4 wherein the hydrogen and hydrocarbon charge stock are heated to a reaction zone temperature of about 1000° F.

After being heated in charge heater 4, the hydrogen and hydrocarbon charge stock are passed via line 5 into catalytic reforming reaction zone 6 and contacted with a reforming catalyst comprising platinum. The effluent therefrom comprising hydrogen and hydrocarbons is withdrawn from reaction zone 6 via line 7 and passed to combined feed exchanger 2. As noted above, the hydrogen and hydrocarbon effluent from reaction zone 6 is subjected to indirect heat exchange with the hydrogen and hydrocarbon feed in line 1. As a result of this heat exchange, the temperature of the reaction zone effluent is lowered from about 1020° F. to about 200° F. In addition, although not depicted in the present drawing, the temperature of the reaction zone effluent is further reduced to about 100° F. or less by subjecting it to indirect heat exchange with ambient air and/or cooling water.

The reaction zone effluent is passed via line 8 to first vapor-liquid equilibrium separation zone 9 to produce a first hydrogen-containing vapor phase comprising 75 to 85 mol. % hydrogen and a first unstabilized liquid reformate. The first vapor-liquid separation zone operates at a temperature of about 100° F. and a pressure of about 50 to 500 psig. The hydrogen-containing vapor phase is withdrawn from vapor-liquid equilibrium separation zone 9 via line 11. In order to satisfy the hydrogen requirements of the catalytic reforming reaction zone, a first portion of the hydrogen-containing vapor phase is passed via line 11 to recycle compressor 12. The first portion of the hydrogen-containing vapor phase is then passed via line 13 for admixture with the naphtha boiling range charge stock in line 1. A second portion of the hydrogen-containing vapor phase comprising the balance thereof is diverted through line 14. The composition of vapor in line 11 is shown in Table 1. The first unstabilized liquid reformate phase is withdrawn from vapor-liquid equilibrium separation zone 9 via line 10. A portion comprising about 20 to 40 vol. % of the total unstabilized liquid reformate is diverted via line 19. The balance of the unstabilized liquid reformate is continued through line 10 and passed to fractionation facilities not depicted herein.

The second hydrogen-containing vapor phase from line 14 may be compressed as necessary to raise its pressure to the range of 50 to 500 psig. After any compression, the second hydrogen-containing vapor phase is passed via line 14 to precooling heat exchanger 17. In pre-cooling heat exchanger 17, the second portion of the hydrogen-containing vapor phase is subjected to indirect heat exchange with a hydrogen-rich gas stream. This heat exchange step reduces the temperature of the hydrogen-containing vapor phase from about 100° to about 50° F. The pre-cooled portion of the hydrogen-containing vapor phase is then withdrawn from pre-cooling heat exchanger 17 via line 18. A 10 to 20 vol. % portion of the unstabilized liquid reformate is passed via line 19 to pre-cooling heat exchanger 20 and indirectly heat exchanged with an unstabilized liquid reformate stream which reduces the temperature of the unstabilized liquid reformate from about 100° to about 30° F. The pre-cooled unstabilized liquid reformate is withdrawn from pre-cooling heat exchanger 20 via line 21 and admixed with the second portion of the hydrogen-containing vapor phase in line 18.

The resulting admixture which is at a temperature of about 20° to 60° F. is passed via line 22 to refrigeration means 23 which has been depicted as a simple box for convenience. The admixture is withdrawn from refrigeration zone 23 at a temperature of −15° to 15° F. via line 24 and is thereafter passed to second vapor-liquid equilibrium separation zone 25 which is maintained at a temperature of about −15° to 15° F. and a pressure of about 50 to 500 psig.

The hydrogen-rich gas stream withdrawn from second vapor-liquid equilibrium separation zone 25 via line 26 is passed to pre-cooling heat exchanger 17 and indirectly heat exchanged with the hydrogen-containing vapor phase. The temperature of the hydrogen-rich gas stream is increased from about 0° to 80° F. as a result of the heat exchange step. The hydrogen-rich gas stream is then withdrawn from pre-cooling heat exchanger 17 via line 27 and passed on for further use in other process units not herein depicted.

The unstabilized liquid reformate withdrawn from vapor-liquid equilibrium separation zone 25 via line 28 is passed to pre-cooling heat exchanger 20 and indirectly heat exchanged with the first unstabilized liquid reformate from line 19. The temperature of the second unstabilized liquid reformate is increased from about 0° to about 60° F. The unstabilized liquid reformate is then withdrawn from pre-cooling heat exchanger 20 via line 29. It is thereafter passed to fractionation facilities not herein depicted.

The recovery of vapor and liquid components from lines 27 and 29 of the prior art arrangement shown in FIG. 1 is listed in Table 1.

Figure 2:
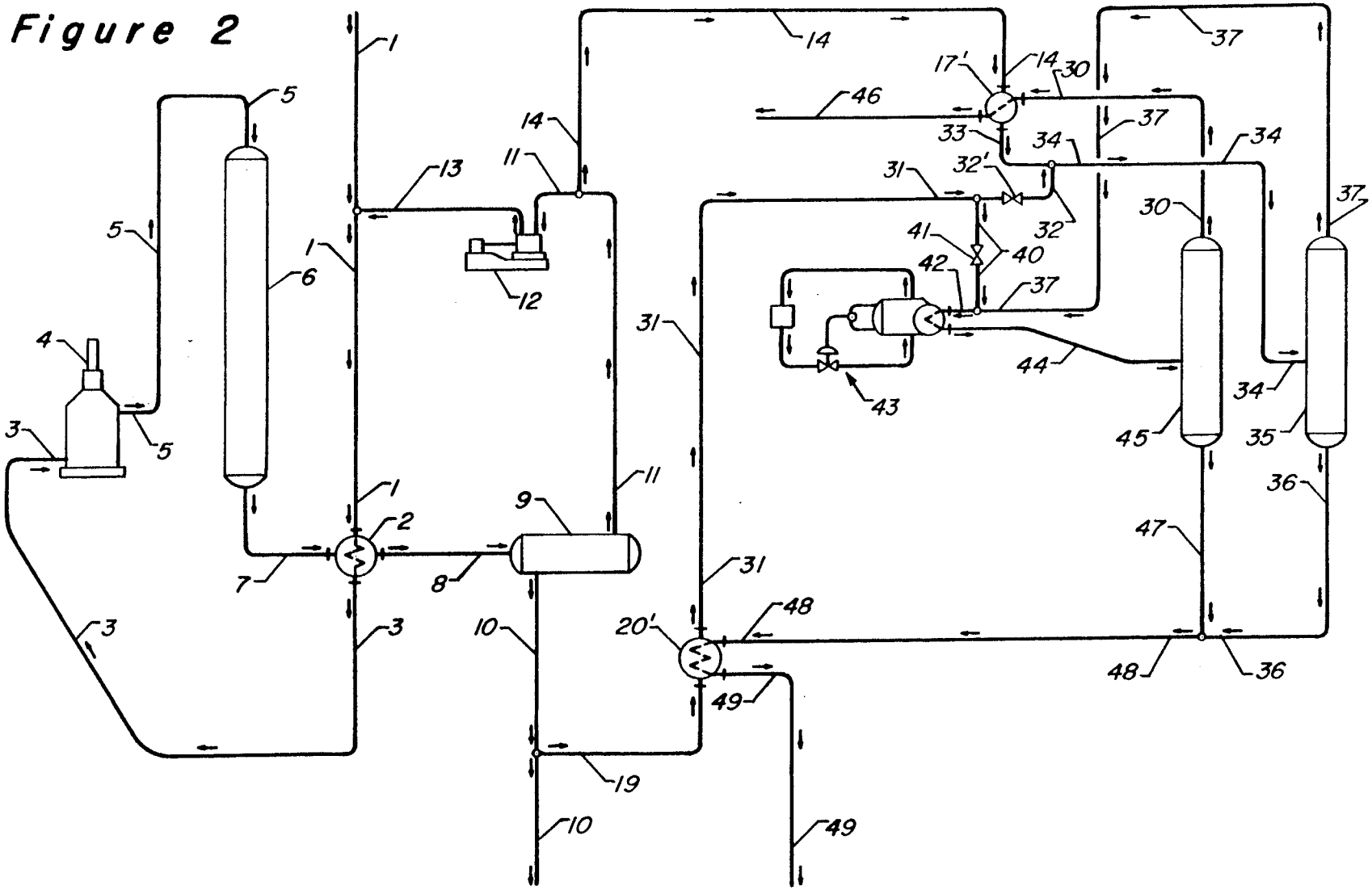
FIG. 2 shows a reforming process with a system for recovering a hydrogen-rich gas product and a reformate liquid product arranged in accordance with this invention.

FIG. 2 shows one arrangement for the process of this invention that is used to process an identical feedstream to that used when describing the prior art process depicted in FIG. 1. The reforming section and the initial separation of the effluent from the reforming zone is identical to that described in the flowscheme of FIG. 1. Therefore, the same reference numerals have been used to indicate the common elements and the description in the context of FIG. 1 applies thereto and will not be repeated.

The hydrogen-containing gas stream having the composition listed in Table 1 is again diverted in part by line 14, compressed if necessary and then carried through a pre-cooling heat exchanger 17' where it is heat exchanged against the hydrogen-rich gas stream carried by line 30. Passing the hydrogen-containing gas stream through pre-cooler 17' cools the gas stream from a temperature of about 100° F. to a temperature of 30° F. The portion of the unstabilized liquid reformate stream carried by line 19 passes through a pre-cooling heat exchanger 20' where it is cooled from a temperature of about 100° F. to a temperature of about 50° F. by heat exchange against liquid reformate stream 48. Line 31 carries the liquid reformate from the pre-cooling heat exchanger 20'. Approximately 50 vol. % of stream 31 is diverted by a line 32 at a rate regulated by a control valve 32' and combined into admixture with the pre-cooled hydrogen-containing gas stream that is carried by line 33. The admixture at a temperature of about 30° to 60° F. is carried by a line 34 into a separator 35. Separator 35 produces an unstabilized liquid reformate stream carried by line 36 from the bottom of the separation zone and a hydrogen-rich containing gas stream taken overhead from the separator by a line 37. Line 37 carries the hydrogen-rich gas stream into admixture with a second portion of the precooled liquid reformate stream from a line 40 at a rate regulated by control valve 41. The admixture of lines 41 and 37 has a temperature of about 30° to 70° F. and is carried by a line 42 into a refrigeration zone 43 that reduces the temperature of the admixture to −15° to 15° F. Line 44 carries the refrigerated admixture from the refrigeration zone to a separator columm 45. Separator 45 provides a hydrogen-rich gas stream having a higher hydrogen purity relative to the overhead carried by line 37. Heat exchange of the hydrogen-rich gas stream in line 30 through pre-cooler 17' raises its temperature to 80° to 100° F. The cooled hydrogen-rich gas stream is recovered from heat exchanger 17' by a line 46 as a hydrogen-rich gas product and has the composition listed in Table 1.

Additional unstabilized liquid reformate is withdrawn from the bottom of separator 45 by a line 47 and combined with the liquid reformate from column 35 into a liquid reformate stream 48. Heat exchange in pre-cooler 20' raises the temperature of the combined liquid reformate of line 48 from to 50° to 80° F. The cooled combined liquid reformate stream is recovered by a line 49 and provides the recovery of liquid product listed in Table 1.

A comparison of the product recoveries for the prior art flow arrangement of FIG. 1 and the flow arrangement of this invention in FIG. 2 shows the unexpected results that have been obtained by the novel flow arrangement of this invention. The addition of a single extra separator was found to almost double the liquid recovery of propane from the hydrogen-containing gas stream. In the prior art example of FIG. 1, the liquid recovery of propane was 29.1% giving a total recovery of 194 barrels per day. By addition of an extra separator and the splitting of the unstabilized portion of the liquid reformate stream in the manner of this invention, the percent liquid recovery of propane rose to 52.1% and provided an additional 154 barrels per day of liquid propane. In addition to the greatly increased propane recovery, there were also significant increases in the recovery of butane. The average percent liquid recovery of butane in the prior art arrangement is approximately 60% and provides a total butane liquid recovery of 227 barrels per day. The recovery arrangement of the instant invention provided an average butane liquid recovery of 67% for an additional liquid recovery of 22 barrels per day.

Figure 3:
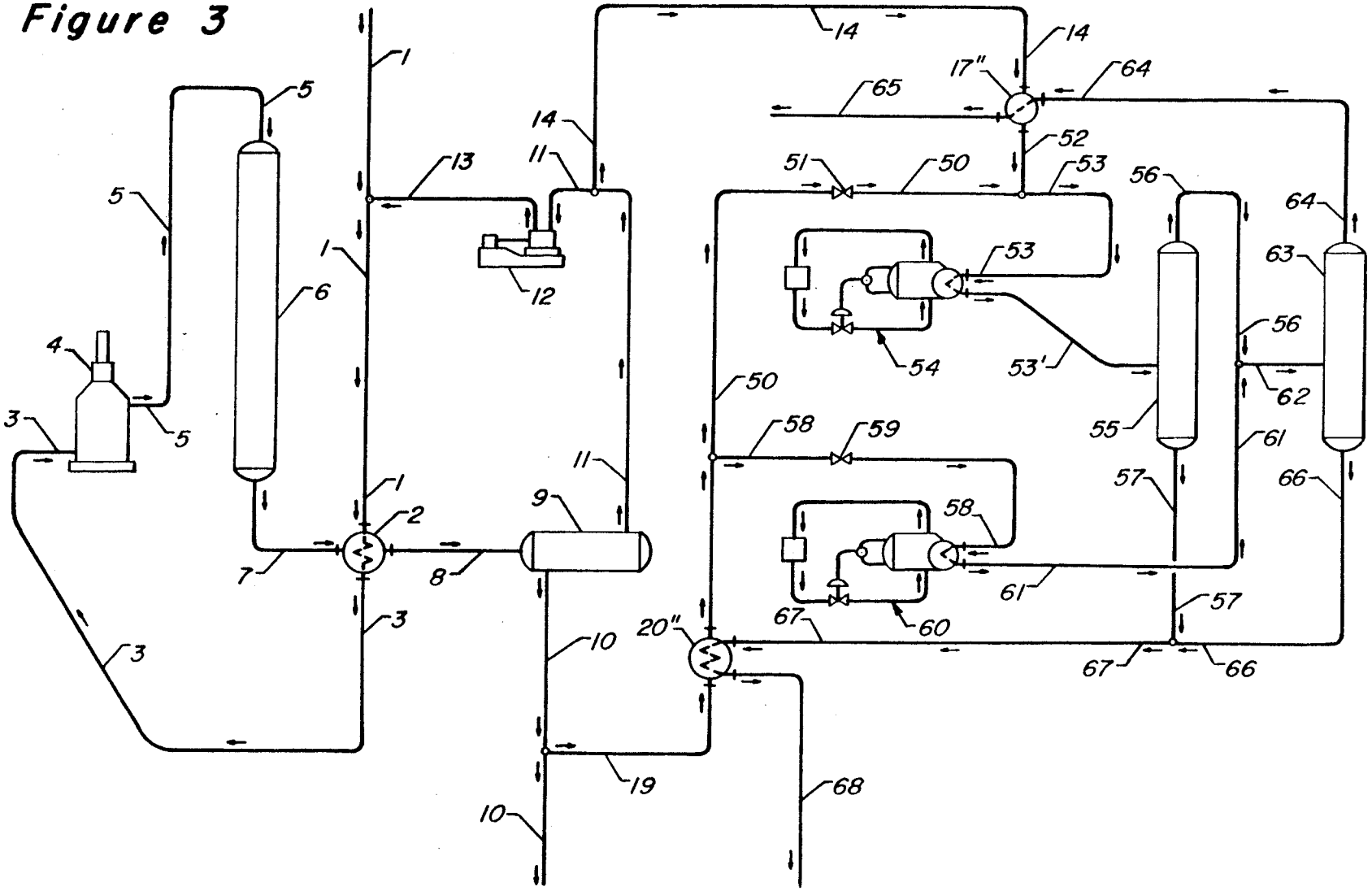
FIG. 3 is another reforming process with a system for recovering a hydrogen-rich product and a liquid reformate arranged in accordance with an alternate embodiment of this invention.

It is possible to further improve the liquid recovery from the hydrogen-rich gas stream by providing additional refrigeration means for the admixture entering the first separation zone. Such an arrangement is shown in FIG. 3. FIG. 3 shows a reforming reaction zone again arranged in an identical manner to that disclosed in FIG. 2 and the description of which therefore does not need repetition.

In the arrangement of FIG. 3, the hydrogen-containing gas stream carried by line 14 passes through a pre-cooler 17'' which cools the hydrogen-containing gas stream against a hydrogen-rich gas stream. The portion of the unstabilized liquid reformate carried by line 19 is again cooled against another unstabilized liquid reformate stream in an exchanger 20''. The cooled liquid reformate stream passes through line 31' and a portion of the cooled liquid reformate stream is taken by a line 50 at a rate regulated by control vave 51 and admixed with the cooled hydrogen-containing gas stream carried by line 522 to provide an admixed stream carried by line 53 to a refrigeration zone 54. Line 53' passes the refrigerated admixture to a separation zone 55 and separates the admixture into a hydrogen-rich gas stream taken overhead by line 56 and a liquid reformate stream taken from the bottom of separator 55 by line 57.

Another portion of the cooled unstabilized liquid reformate stream is taken from line 31' by a line 58 at a rate regulated by a control valve 59 into another refrigeration unit 60. Line 61 carries the refrigerated liquid reformate stream into admixture with the overhead hydrogen-rich stream 56 to provide an admixture carried by line 62 into another separator 63. A hydrogen-rich gas stream having a higher hydrogen purity relative to the hydrogen-rich gas stream carried by line 56 is taken overhead from separator 63 by a line 64. The hydrogen-rich gas stream carried by line 64 is heated in heat exchanger 17' and recovered from the process through a line 65. Another unstabilized liquid reformate stream is taken from the bottom of separator 63 by a line 66 and combined with the liquid stream from line 57 to provide a combined liquid reformate stream. Line 67 carries the combined liquid reformate stream to heat exchanger 20'' wherein it is heated and recovered by line 68 as a liquid reformate product having an increased quantity of $C_3$ and $C_4$ hydrocarbons.

TABLE 1

| | | PRIOR ART (FIG. 1) | | | ARRANGEMENT OF FIG. 2 | | |
|---|---|---|---|---|---|---|---|
| | lb mol/hr Vapor In | lb mol/hr Vapor Out (Line 27) | % liquid Recovery (Line 29) | BPD Liq Recovery (Line 29) | lb mol/hr Vapor Out (Line 46) | % liquid Recovery (Line 49) | BPD Liq Recovery (Line 49) |
| Hydrogen | 5496.96 | 5494.01 | — | — | 5496.13 | — | — |
| Methane | 244.84 | 242.59 | — | — | 239.49 | — | — |
| Ethane | 189.31 | 176.52 | — | — | 155.23 | — | — |
| Propane | 112.01 | 79.38 | 29.1 | 194 | 53.65 | 52.1 | 348 |
| i Butane | 24.65 | 10.94 | 55.6 | 97 | 8.50 | 65.5 | 114 |
| n Butane | 28.90 | 9.82 | 66.0 | 130 | 9.02 | 68.8 | 135 |
| i Pentane | 13.09 | 2.18 | 83.4 | 86 | 1.74 | 86.7 | 90 |
| n Pentane | 6.89 | 0.89 | 87.1 | 47 | 0.81 | 88.3 | 48 |
| Hexane+ | 33.34 | 2.08 | 93.8 | 268 | 2.27 | 93.2 | 266 |
| Total | 6147.95 | 6018.39 | — | 822 | 5966.84 | — | 1001 |

What is claimed is:

1. A process for producing a hydrogen-rich gas stream by treating a hydrogen and hydrocarbon effluent from a catalytic hydrocarbon conversion reaction zone comprising the steps of:

(a) passing at least a portion of said effluent to a first vapor-liquid separation zone and recovering therefrom a hydrogen-containing vapor phase and a first liquid phase hydrocarbons;

(b) passing at least a portion of the hydrogen-containing vapor phase in indirect heat exchange with a first hydrogen-rich gas stream;

(c) passing only a portion of the first liquid phase comprising about 10 to 50 vol. % of the total first liquid phase in indirect heat exchange with a second liquid phase;

(d) admixing the heat exchanged portion of the hydrogen-containing vapor phase and a first portion of the heat exchanged portion of the first liquid phase to produce a first admixture;

(e) passing the first admixture to a second vapor-liquid separation zone to produce a second hydrogen-rich gas stream and a third liquid phase;

(f) refrigerating at least one of said second hydrogen-rich gas stream and a second portion of said first liquid phase portion and admixing said second hydrogen-rich gas stream with said second portion of said first liquid phase portion to obtain a refrigerated second admixture;

(g) passing the refrigerating second admixture to a third vapor liquid separation zone to produce said first hydrogen-rich gas stream and a fourth liquid phase;

(h) combining said third and fourth liquid phases to produce said second liquid phase and recovering said second liquid phase after the heat exchange of step c; and (i) recovering said first hydrogen-rich gas stream after the heat exchange of step (b).

2. The process of claim 1 wherein said first admixture is refrigerated and said refrigerated admixture is passed to said second vapor-liquid separation device.

3. The process of claim 1 wherein the catalytic hydrocarbon conversion zone comprises a catalytic reforming reaction zone.

4. The process of claim 1 wherein the first portion of the hydrogen-containing vapor phase is dried prior to indirect heat exchange with the first hydrogen-rich stream.

5. The process of claim 1 wherein the molar ratio of the portion of the first liquid phase passing in indirect heat exchange pursuant to step (c) to the hydrogen-containing vapor phase is about 0.25 to 0.5.

6. The process of claim 1 wherein the portion of the first liquid phase passing in heat exchange pursuant to step (c) comprises about 20 to 40 vol. % of the total first liquid phase.

7. The process of claim 1 wherein said first admixture enters said second separation zone at a temperature of from 20° to 60° F. and a pressure of from 50 to 500 psig.

8. The process of claim 2 wherein said first admixture enters said second separation zone at a temperature of from −15° to 15° F. and a pressure of from 50 to 500 psig.

9. The process of claim 1 wherein the refrigerated admixture enters the third separation zone at a temperature of from −15 to 15 and a pressure of from 50 to 500 psig.

10. The process of claim 1 wherein from 40 to 60 vol. % of said first portion of said heat exchanged first liquid phase is admixed with said heat exchanged hydrogen-containing vapor stream.

11. The process of claim 1 wherein the second hydrogen rich gas stream and said second portion of said first liquid phase are combined before refrigeration.

12. The process of claim 1 wherein said heat exchanged hydrogen-containing vapor phase and said first portion of said heat exchanged first liquid phase are admixed and passed to said second vapor-liquid separation zone without refrigeration.

13. A process for producing a hydrogen-rich gas stream by treating a hydrogen and hydrocarbon effluent from a catalytic reforming reaction zone comprising the steps of:

(a) passing the hydrogen and hydrocarbon effluent to a first vapor-liquid equilibrium separation zone and recovering therefrom a hydrogen-containing vapor phase and an unstabilized liquid reformate;

(b) recycling a first portion of the hydrogen-containing vapor phase for admixture with the catalytic reforming reaction zone charge stock;

(c) passing a second portion of the hydrogen-containing vapor phase in indirect heat exchange with a first hydrogen-rich gas stream;

(d) passing only from about 10 to 50 vol. % of the unstabilized liquid reformate in indirect heat exchange with a second unstabilized liquid reformate;

(e) admixing the heat exchanged portion of the hydrogen-containing vapor phase and a first part of the heat exchanged portion of the first unstabilized, liquid reformate to produce a first admixture;

(f) passing the first admixture to a second vapor-liquid separation zone to produce a second hydrogen-rich gas stream and a third unstabilized liquid reformate;

(g) admixing said second hydrogen-rich stream with a second part of the heat exchanged portion of the first unstabilized liquid reformate and refrigerating said second hydrogen-rich gas phase to obtain a refrigerated second admixture;

(h) passing the refrigerated second admixture to a third vapor liquid separation zone to produce said first hydrogen-rich gas stream and a fourth unstabilized liquid reformate;

(i) combining said third and fourth unstabilized liquid reformates to produce said second unstabilized liquid reformate and recovering said second unstabilized liquid reformate after the heat exchange of step c; and (j) recovering said first hydrogen-rich gas stream after the heat exchange of step b.

14. The process of claim 13 wherein said first admixture is refrigerated and said refrigerated admixture is passed to said second vapor-liquid separation device.

15. The process of claim 13 wherein the second portion of the hydrogen-containing vapor phase is dried prior to passing it in indirect heat exchange with said first hydrogen-rich gas stream.

16. The process of claim 13 wherein the molar ratio of the unstabilized liquid reformate passing in indirect heat exchange pursuant to step (d) to the second portion of the hydrogen-containing vapor phase is about 0.25 to 0.5.

17. The process of claim 13 wherein the unstabilized reformate passing in indirect heat exchange pursuant to step (d) comprises about 20 to 40 vol. % of the total first liquid phase

* * * * *

UNITED STATES PATENT AND TRADEMARK OFFICE

CERTIFICATE OF CORRECTION

PATENT NO. : 5,178,751

DATED : January 12, 1993

INVENTOR(S) : Scott W. Pappas

It is certified that error appears in the above-identified patent and that said Letters Patent is hereby corrected as shown below:

In Column 17, line 1: Change "refrigerating" to --refrigerated--.

Signed and Sealed this

Eighteenth Day of January, 1994

Attest:

Bruce Lehman

BRUCE LEHMAN

Attesting Officer

Commissioner of Patents and Trademarks